US006041581A

United States Patent [19]

Huber

[11] Patent Number: 6,041,581

[45] Date of Patent: Mar. 28, 2000

[54] BAND MOVING DEVICE OF A STRAPPING DEVICE

[75] Inventor: Hans Huber, Bremgarten, Switzerland

[73] Assignee: Orgapack GmbH, Dietikon, Switzerland

[21] Appl. No.: 09/123,285

[22] Filed: Jul. 28, 1998

[30] Foreign Application Priority Data

Jul. 28, 1997 [CH] Switzerland ..... 1807/97

[51] Int. Cl.[7] ..... B65B 13/04; B65B 41/12

[52] U.S. Cl. ..... 53/589; 53/389.5; 100/26; 100/32

[58] Field of Search ..... 53/582, 589, 389.5; 100/25, 26, 29, 32

[56] References Cited

U.S. PATENT DOCUMENTS

| | | | |
|---|---|---|---|
| 1,750,059 | 3/1930 | Selden | 53/589 |
| 3,752,058 | 8/1973 | Lems | 100/32 |
| 4,244,773 | 1/1981 | Siebeck et al. | 53/589 |
| 4,444,097 | 4/1984 | Wehr et al. | 100/32 X |
| 4,691,498 | 9/1987 | Stamm | 53/589 X |
| 5,146,847 | 9/1992 | Lyon et al. | 53/589 |
| 5,379,576 | 1/1995 | Koyama . | |
| 5,459,977 | 10/1995 | Haberstroh . | |

FOREIGN PATENT DOCUMENTS

| | | |
|---|---|---|
| 0 064 734 | 11/1982 | European Pat. Off. . |
| 0 154 955 | 9/1985 | European Pat. Off. . |
| 0 669 252 | 8/1995 | European Pat. Off. . |
| 1 611 979 | 4/1971 | Germany . |
| 33 00 039 | 7/1983 | Germany . |
| 32 49 559 | 8/1985 | Germany . |
| 195 47 282 | 8/1996 | Germany . |
| 195 23 274 | 1/1997 | Germany . |
| 20396 | 1/1977 | Italy . |
| 641 107 | 2/1979 | Switzerland . |
| 662 791 | 3/1984 | Switzerland . |

*Primary Examiner*—Linda Johnson
*Attorney, Agent, or Firm*—Lowe Hauptman Gopstein Gilman & Berner

[57] ABSTRACT

A strapping device for hooping a package with a band and a band moving device. The band moving device includes an enveloping component, two wheels engaging the inner surface of the enveloping component, a pressure pulley for pressing the band onto the outer surface of the enveloping component where the enveloping component wraps around one of the wheels, a reversing mechanism, and a movable tensioning wheel. The pressure pulley is arranged in the region where the enveloping component wraps around a guide wheel. The device includes a sensor for monitoring the pressure pulley and a control unit for receiving a signal from the sensor.

15 Claims, 3 Drawing Sheets

BAND MOVING DEVICE OF A STRAPPING DEVICE

TECHNICAL FIELD

The invention relates to a band moving device of a strapping device for applying a band around a package, as well as to the strapping device provided with a band moving device.

BACKGROUND ART

A large number of strapping devices for applying a band around goods to be packaged are known. Although these devices to some extent differ from one another sharply in design terms, they share the common characteristic that they each have a band moving device with which the band is pulled from a delivery spool and the feeding motion of the band for forming a band loop around the package is produced. After the band loop has been formed, it is necessary for the band to be applied tautly to the package. In order to produce the necessary band tension, the band is pulled back until the necessary band tension is applied. For this operation, the band moving device is also normally used.

In the known band moving devices, a distinction may in principle be drawn between two types. In the case of the first type, the band is guided over a circulating belt of a belt drive or envelope drive. In this case, the band is carried along by frictional forces between the belt and the band. In the case of the second type of band moving device, a feeding motion of the band is achieved by the latter being guided directly over one or more rollers. Here, too, a frictional force—namely between the rollers and the band—is used.

The present invention relates to the first type of band moving devices, which is disclosed, for example, by Swiss Patent 662 791. There, a description is given of a strapping device having a band moving device in which a belt is guided over a guide roller and a drive roller. In order that a frictional force that is necessary for the feeding and the tensioning of the band occurs between the band and the belt, an eccentric disc presses the band against the belt. In the case of this device, it has been shown to be particularly advantageous that the band does not rest on the guide roller only in the region of the wrap angle of the belt. Because of the eccentric disc, on the one hand a greater wrap angle of the belt around the guide roller is established. In addition, the effect of the eccentric disc is also that the band rests against the belt outside the region of the wrap angle, which results in a relatively large contact surface between the belt and the band. This type of band moving device is therefore predestined for the application of particularly high tensioning forces.

In spite of these advantages, the arrangement is not completely satisfactory, since band deformations may result, in particular because of the deflection of the band by the eccentric disc. These band deformations are particularly disadvantageous in the automatic hooping of packages using bands, since they make the satisfactory guidance of the band during the formation of the band loop more difficult, even if they do not in fact prevent it. Band deformations of this type can lead to automated strapping devices coming to a standstill. In order to restart the machine following standstill, and to ensure satisfactory operation, the deformed band section is as a rule removed as waste.

SUMMARY OF THE INVENTION

The invention is therefore based on the object of developing a band moving device of the above type and a strapping device—which is provided with a band moving device—to the extent that the risk of producing band deformations of this type is at least reduced.

This object is achieved by an inventive band moving device of a strapping device for applying a band around a package, which device is provided with an envelope drive having only one enveloping component, which is guided, by way of an inner surface, over at least two wheels, at least one of the two wheels being designed as a drive wheel that can be brought into operative connection with a drive motor to drive the enveloping component, it being possible to press the band onto an outer surface of the enveloping component by means of a pressure pulley in order to produce, between the band and the enveloping component, a frictional force by means of which the band can be moved in one direction, the pressure pulley being arranged in a region in which the enveloping component wraps around one of the two wheels, this making it possible for the enveloping component to be pressed against one of the two wheels by the pressure pulley, there a reversing mechanism connected for reversing the direction of rotation of the enveloping component, so that the band can be moved both in a feeding direction and in a tensioning direction, and there being a further wheel, which is located opposite the outer surface of the enveloping component, is designed as a tensioning wheel and, during a tensioning phase, presses the band onto the enveloping component in order to apply a band tension.

The object is additionally achieved by a strapping device having the above-mentioned band moving device.

A significant aspect of the invention thus consists in the fact that, for the tensioning phase—that is to say the time interval during which there is applied to the band the band tension at which the band is subsequently sealed—use is made of a separate tensioning wheel. The measure of using a different wheel for producing a feeding motion of up to 4 m/s and for applying the tensioning force in each case makes it possible to apply the tensioning wheel to the band only during the tensioning phase. As a result, the band rests only flatly on the enveloping component, for example a V-belt, and is also then only subject to a deflection by a tensioning wheel when it is actually tensioned. Band deformations because of a wheel producing the tension in the band—as caused by the eccentric disc from Swiss Patent 662791—can thus essentially be prevented, since in particular when the strapping device is at a standstill, the feared "memory effect" is not established in the band. To be specific, it has been shown that a significant cause of band deformations is the relatively longer-lasting wrapping of a band around a wheel or a roller whilst under high band tension. In this case, the band permanently assumes a shape which corresponds to its course in the band moving device.

In preferred embodiments of the invention, the tensioning wheel can be transferred into two end positions, this expediently being carried out by means of a pivoting motion. In the first end position, the tensioning wheel is arranged at a distance from the band and from the belt, so that no contact between the tensioning wheel and the belt occurs. In the second end position, which the tensioning wheel assumes only in the tensioning phase, the tensioning wheel is pivoted in the direction of the belt, so that the result is that the band and the belt wrap partly around the tensioning wheel.

It has proven to be advantageous if the tensioning wheel itself is not driven. The rotational motion of a belt, which is necessary for the tensioning, can expediently be generated by the first drive wheel.

In further expedient embodiments of the invention, the band moving device has a second drive wheel, which can be arranged in a position in which it is pressed against an outer surface of the enveloping component or belt and is wrapped around partly by the latter. The second drive wheel can be used for generating the feeding motion of the belt, that is to say the motion with which the belt pulls the band from a delivery spool, in order to enable the formation of a band loop around the package. However, it is also preferred for the second drive wheel also to be used for generating the rotation of the enveloping component that is necessary for a pulling-back motion of the band. In this connection, it may be expedient to use only the second drive wheel both for the feeding motion and for the pulling-back motion. In addition, provision may be made to use the second drive wheel only for this second motion.

In further advantageous embodiments of the invention, the second drive wheel rests against the belt with a pressing force which is preferably produced by a spring. In addition, the second drive wheel is pivotably hinged, without locking it in a specific position. Since the belt is also not clamped in between a mating wheel, such as the guide wheel, on the other side of the belt, and the drive wheel, the position of the second drive wheel results from the belt tension. The second drive wheel thus also inherently has the function of a belt tensioner.

In order to obtain good frictional relationships, in a further preferred embodiment of the invention, the pressure pulley rests on the band in the feeding phase, the pulling-back phase and in the tensioning phase, and presses the said band onto one of the two wheels, preferably onto a guide wheel that is not driven.

Further preferred configurations of the invention emerge from the dependent claims.

DETAILED DESCRIPTION OF THE INVENTION

Figure 1:
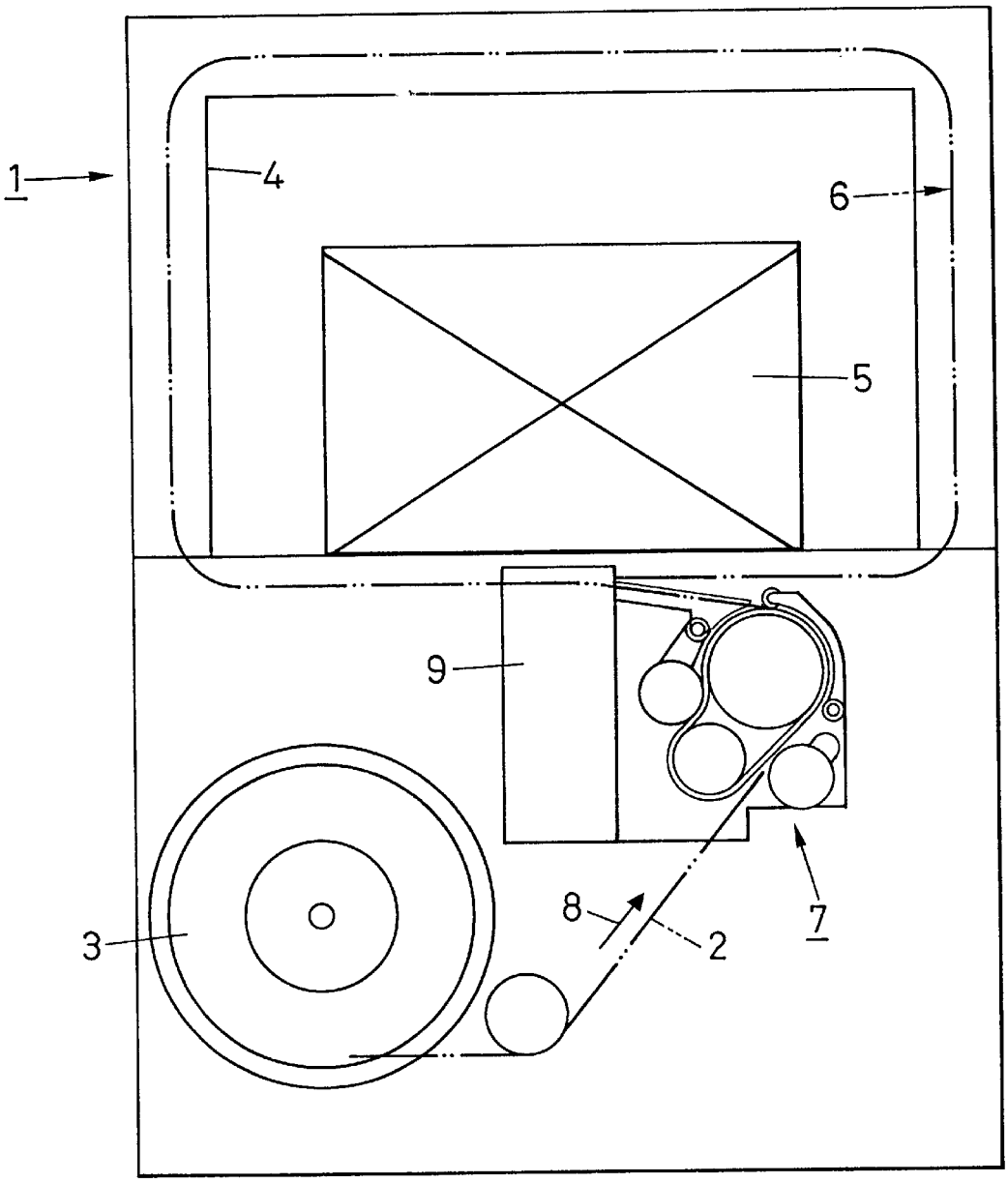
FIG. 1 shows a strapping device in a side view, having an inventive band moving device.

FIG. 1 shows an automated strapping device 1 resp. hooping mechanism, illustrated very schematically, with which a plastic band 2 is pulled off from a delivery spool 3 and, in a guide 4, is placed around a package 5. In the illustration of FIG. 1, the plastic band 2 already surrounds the package 5 loosely by way of a loop 6.

A band moving device 7 of the strapping device 1 carries out the feeding, pulling back and the tensioning of the band 2. After the desired tension has been applied to the band, the band is sealed by means of friction welding by a sealing unit 9 that is arranged downstream of the band moving device 7 in the feeding direction (corresponding to arrow 8) of the band, and the loop 6 is severed from the band 2. Of course, it would also be possible for the ends of the band loop 6 to be joined to each other by means of any other joining technique.

Figure 2:
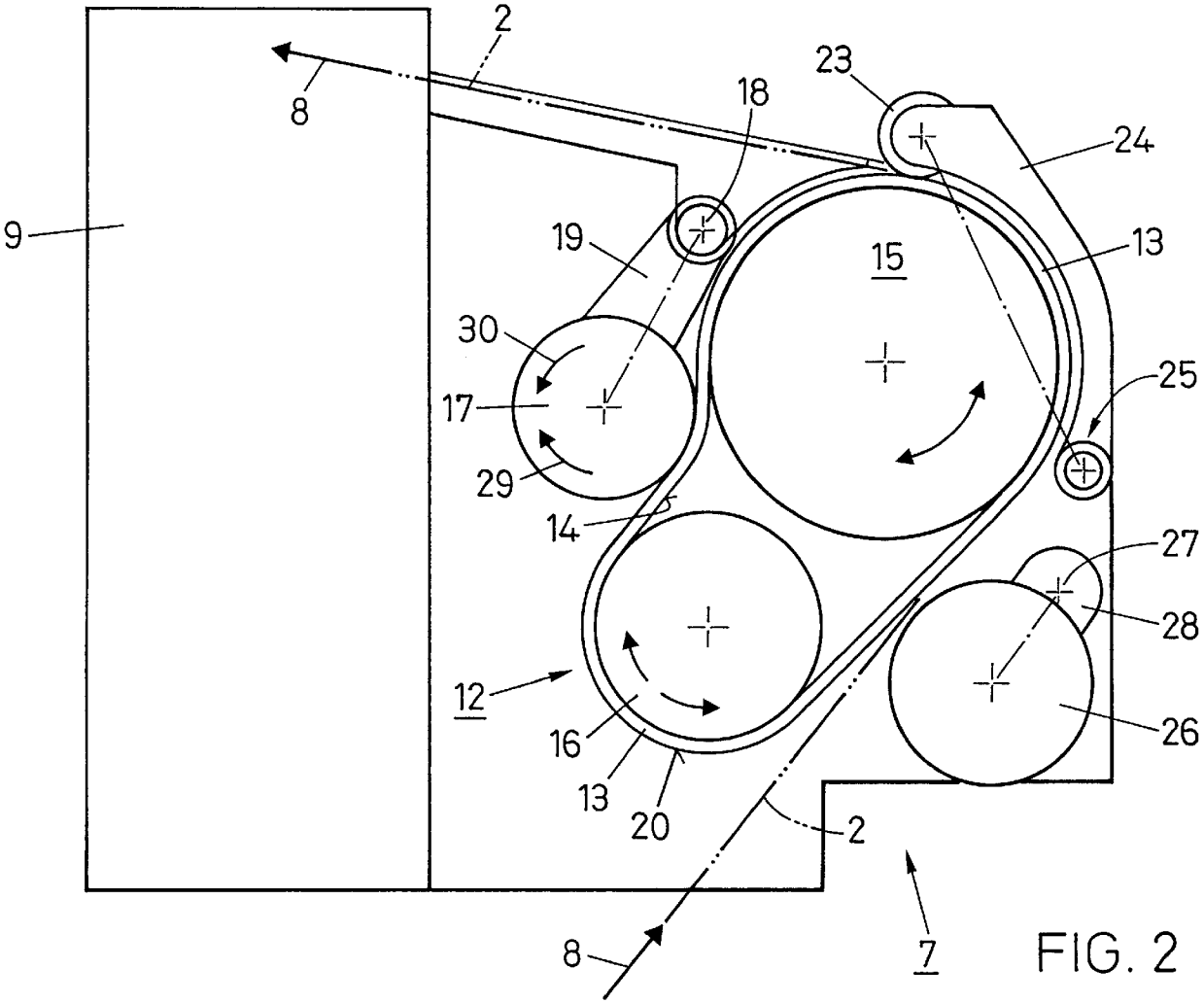
FIG. 2 shows the band moving device from FIG. 1 during a feeding phase and pulling-back phase.

It can be seen in FIG. 2 that the band moving device 7 has an envelope drive 12 having an enveloping component designed as a multiple V-belt 13. The V-belt 13 runs by way of its inner surface 14 over two wheels 15, 16 of different diameters. In this case, the smaller wheel is a first drive wheel 16 for the belt, and is driven by a DC motor (not illustrated) via a spiroidal gearbox. The larger wheel is a non-driven, freely running guide or deflecting wheel 15, with which the band 2 is deflected from its direction, in which it runs into the band moving device, in the direction of the sealing unit 9. In order to make belt changing easier, and for the purpose of adjusting the belt tension, the distance between the guide wheel 15 and the drive wheel 16 can be varied (in a manner not illustrated), for example by the guide wheel being arranged on a pivoting lever.

In order to produce the feeding and pulling-back motion, the band moving device 7 has a second drive wheel 17 that can be driven by a DC motor (likewise not illustrated). The second drive wheel 17 is mounted on a lever 19 that can pivot about an axis 18, and is pressed against an outer surface 20 of the belt 13 by a spring (not illustrated). As a result, the belt 13 wraps around a section of the circumference of the second drive wheel 17, by which means the latter transmits its rotational motion to the belt 13.

A non-driven pressure pulley 23 is arranged with its axis at one end of a further lever 24. The lever 24, which runs approximately along an arc, is pivotably mounted at its other end 25, so that a gap, in which the belt 13 and the band 2 run, is formed between the lever 24 and the guide wheel 15. In addition, the pressure pulley 23 is pressed in the direction of the guide wheel 15 by a spring that is not specifically illustrated. The pressure pulley 23 thus presses the band 2 onto the outer surface 20 of the belt. The pressing pressure of the pressure pulley 23 causes the production of a frictional force, effecting the feeding, between the belt 13 and the band 2. The point at which the essentially linear contact occurs between the pressure pulley 23 and the band 2 is located, on the one hand, in the region in which the belt wraps around the guide wheel 15; on the other hand, the pressure pulley 23 presses onto the band 2 at a point at which the band lifts off the belt 13 and extends tangentially from the guide wheel 15.

Moreover, the pressure pulley 23 is provided with a sensor (not illustrated), with which its rotational speed, but at least its state of rotation, is detectable. In the event of a standstill of the pressure pulley 23, the sensor sends an appropriate signal to a central control unit, likewise not illustrated, of the hooping mechanism.

Figure 3:
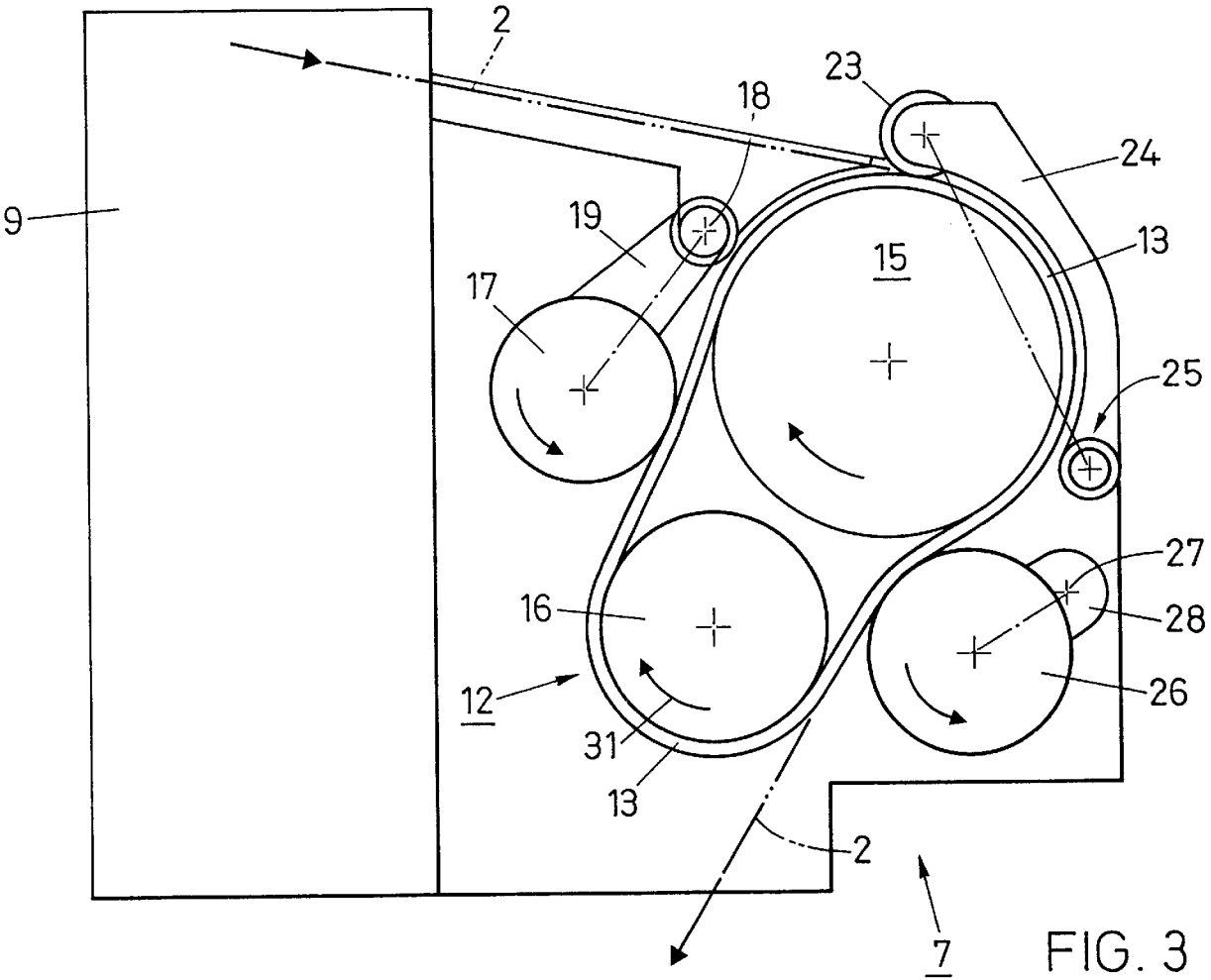
FIG. 3 shows the band moving device from FIG. 1 during a tensioning phase.

As can be taken from FIGS. 2 and 3, the band moving device 7 has a freely rotatable tensioning wheel 26, which is likewise arranged on a lever 28 that can pivot about an axis 27. The tensioning wheel can be transferred into two end positions by means of the pivoting lever 28. In the first end position, illustrated in FIG. 2, the tensioning wheel 26 is arranged at a distance from the band 2 and has no contact with the latter. By means of a pivoting motion of the lever 28, the tensioning wheel 26 can be transferred into the second end position, illustrated in FIG. 3, in which the tensioning wheel 26 presses the band 2 against the belt 13, so that both the band 2 and the belt 13 partly wrap around the circumference of the tensioning wheel 26. That part of the belt 13 which in each case wraps around the tensioning wheel 26 is located freely between the two wheels 15, 16, without resting on the latter or being clamped between the latter and the tensioning wheel 26. The effect of pivoting the tensioning wheel 26 is that the belt 13 and the band 2 are subjected to an additional deflection. As a result, the band 2 rests on the belt along a longer path as compared with the previously described feeding and pulling-back phase. In relation to an (imaginary) straight line connecting the axes of the two wheels 15, 16, the tensioning wheel 26, when it is in its second end position, is located approximately at the level of the centre of the connecting straight line. The second drive wheel 17 is located on the other side, in relation to the abovementioned connecting straight line, but likewise approximately at the level of the centre of this straight line and thus opposite the tensioning wheel.

By pivoting the tensioning wheel 26 in, firstly the belt tension is increased. The effect of this is that the belt 13 presses the second drive wheel 17 counter to the spring force acting on the lever 19—in the direction away from the tensioning wheel 26. As a result, the wrap angle of the belt around the second drive wheel 17 decreases during the tensioning phase. The second drive wheel 17 thus additionally acts as a belt tensioner, with which a predetermined belt tension can be set.

In order to produce the motions of the individual elements of the band moving device, in the first place the first and the second drive wheel 16, 17 are each provided with their own separate (not illustrated) drive motor. In addition, the strapping device 1 according to the invention has a further drive motor, which is likewise not illustrated in the figures, is designed as a DC motor, and with which the pivoting motion of the lever 28 of the tensioning wheel 26 is produced.

Both the drive motors of the drive wheels 16, 17 and the drive motor of the pivoting lever are driven by a higher-order, central control unit of the hooping mechanism 1.

In order to produce the feeding motion of the band, the second drive wheel 17 is driven by its DC motor, so that it rotates in the clockwise direction, as indicated in FIG. 2 by the arrow 29. Frictional connection with the drive wheel 17 drives the belt 13, as a result of which the belt rotates in the anti-clockwise direction. Since the belt 13 is seated on the two wheels 15, 16 with a specific tension, the wheels are driven along by the belt motion. As has already been explained, the pressure pulley 23 presses the band 2 against the belt, by which means, essentially in the region of the pressure pulley 23, a frictional connection between the band and the belt 13 is also produced. This frictional connection effects the feeding (arrow 8) of the band 2 for forming the band loop around the package 5 in the guide 4 (FIG. 1). As soon as the end of the band from the guide 4 enters the sealing unit 9 again and there actuates a stop (not illustrated) that is designed as a limit switch, the drive motor of the second drive wheel 17 is switched off, and the end of the band is firmly clamped. In order to bring this motor to a standstill particularly quickly, it is braked using countercurrent.

After this feeding phase has been completed, the band surrounds the package 5 loosely, that is to say it surrounds the package without contacting the latter. In the following pulling-back phase, the band 2 is pulled back in the direction opposite to that of arrow 8, in order to apply it to the package 5. The pulling-back phase begins with switching on and reversing the direction of rotation of the second drive wheel 17. The second drive wheel 17 thus rotates in the anti-clockwise direction during the pulling-back phase, which is indicated in FIG. 2 by the arrow 30. The pressure of the pressure pulley 23 onto the band now has the effect that the band is pulled back from the belt in the direction towards the delivery spool 3, until the band rests on the package. The pulling-back motion ends when the band has been provided with a tensioning force which is greater than the frictional force between the belt 13 and the band 2. When this state is reached, both the band and the pressure pulley 23 remain stationary, and the belt slips under the band.

As soon as the sensor of the pressure pulley has detected the standstill of the latter, the control unit causes the tensioning wheel 26 to be pivoted in from its first end position into its second end position (FIG. 3), as a result of which the tensioning phase is initiated. The tensioning phase is distinguished by the fact that the band is pulled back over only a relatively small band length, and the band tension is essentially increased.

At the same time as the tensioning wheel 26 is pivoted in, the motor of the second drive wheel 17 is switched off and the first drive wheel 16 is driven with a clockwise direction of rotation (arrow 31). At the same time, the pivoting lever 28 actuates a mechanical toothed coupling (not illustrated), by means of which the first drive wheel 16 is coupled to its drive motor. The toothed coupling has an internally toothed gearwheel on the side of the drive wheel 16 and an externally toothed pinion on the side of the drive motor. In order that the teeth of the pinion are able to find the corresponding tooth gaps in the gearwheel, the electric motor is already rotating the pinion during this operation. By comparison with the previously known band moving devices for coupling moving elements to drive motors of electromechanical friction couplings, which were hitherto often the norm, virtually no wear occurs in the case of this coupling. In addition, it is possible for very high tensioning forces of up to 4000 N to be transmitted using these types of coupling.

The frictional force, required to apply a tensioning force of up to 4000 N, between band and belt can firstly be produced by the diameter of the first drive wheel 16 being greater than that of the second drive wheel 17, which permits greater torques. Secondly, the band is subject to additional deflection by the tensioning wheel 26, as a result of which it also rests on the belt over a longer path. The frictional force that can be transmitted from the belt to the band is thus increased. Finally, the level of the tensioning force can be limited by controlling the torque of the drive motor of the first drive wheel 16. Since the drive motor of the second drive wheel 17 is switched off during the tensioning phase, the tensioning wheel corotates freely during the tensioning operation.

After the desired tensioning force has been reached, the sealing unit 9 comes into use. The point on the band 2 which is intended to be joined to the end of the band is now also clamped in the said sealing unit. After the drive motor of the first drive wheel 16 has also been switched off, the band loop is welded to the end of the band and severed from the band 2 supplied.

After the band has been clamped in the sealing unit, the control unit again brings about transfer of the tensioning wheel 26 from its second into its first end position. As a result, the tensioning wheel 26 lifts off the band 2 and relieves the load on the latter. Thus—after the completion of the tensioning phase until the beginning of the next feeding phase—the band has an essentially linear contact with the belt 13 only in the region of the pressure pulley 23. By this means, it is possible for a permanent band deformation because of the "memory effect" to be prevented.

I claim:

1. Band moving device of a strapping device for applying a band around a package, comprising:

only one enveloping component and at least two wheels engaging an inner surface of said component, at least one of said two wheels being a drive wheel operatively connectable with a drive motor to drive the enveloping component, a pressure pulley positioned to press the band onto an outer surface of the enveloping component to produce, between the band and the enveloping component, a frictional force to move the band in one direction, said pressure pulley being arranged in a region in which the enveloping component wraps around one of the two wheels to thereby press the enveloping component against one of the two wheels, a reversing mechanism connected to reverse the direction of rotation of the enveloping component, so that the band can be moved both in a feeding direction and in a tensioning direction, and a tensioning wheel located opposite the outer surface (20) of the enveloping component and being moveable, during a tensioning phase, to press the band (2) onto the enveloping component in order to apply a band tension.

2. Band moving device according to claim 1, wherein the tensioning wheel (26) is moveable into two end positions, the tensioning wheel (26) being arranged at a distance from the enveloping component when in the first end position, and the enveloping component partly wrapping around the tensioning wheel (26) when the tensioning wheel is in the second end position.

3. Band moving device according to claim 1, wherein the tensioning wheel (26) is pivotably hinged on a lever (28).

4. Band moving device according to claim 1, further comprising a second drive wheel (17) for engaging the outer surface to drive the enveloping component.

5. Band moving device according to claim 4, wherein the position of the second drive wheel (17) can be varied with respect to the position of the first drive wheel (16).

6. Band moving device according to claim 5, wherein the second drive wheel (17) is pivotably mounted on a lever (19), and an elastic spring arranged to act on the lever to press the second drive wheel (17) onto the enveloping component.

7. Band moving device according to claim 4, wherein, during a feeding phase in which the band is subjected to a feeding motion by being pulled from a delivery spool, only the second drive wheel (17) drives the enveloping component.

8. Band moving device according to claim 1, wherein, during a tensioning phase in which the band is pulled back counter to the feeding direction in order to apply the band tension, the enveloping component can be driven only by the first drive wheel (16).

9. Band moving device according to claim 4, wherein the pressure pulley (23) is connected to a sensor that monitors the state of rotation, including a standstill position, of the pressure pulley (23), the sensor sending a signal to a control unit indicative of a specific state of rotation, including a standstill position, of the pressure pulley, whereby the control unit switches off a drive motor of one of the drive wheels (16, 17) and the control unit then causes the tensioning wheel (26) to be pressed against the enveloping component and to generate a drive motion of the other drive wheel (16, 17).

10. Band moving device according to claim 1, wherein one of said two wheels is a guide wheel and the pressure pulley (23) is arranged in that region of a wrap angle by which the enveloping component wraps around the guide wheel (15), and wherein the pressure pulley (23) presses the band against the enveloping component and thereby presses the enveloping component against the guide wheel (15).

11. Band moving device according to claim 1, wherein the enveloping component is a V-belt (13).

12. Band moving device of claim 1, wherein to prevent excessive band feeding, a drive motor can be braked using countercurrent.

13. Band moving device according to claim 1, wherein the pressure pulley (23) rests on the band in a feeding phase, a pulling-back phase and in a tensioning phase.

14. Band moving device according to claim 1, wherein the tensioning wheel (26) is engaged with the enveloping component only during the tensioning phase.

15. In combination, comprising a strapping device for hooping a package with a band and a band moving device (7) comprising:

only one enveloping component and at least two wheels engaging an inner surface of said component, at least one of said two wheels being a drive wheel operatively connectable with a drive motor to drive the enveloping component, a pressure Pulley positioned to press the band onto an outer surface of the enveloping component to produce, between the band and the enveloping component, a frictional force to move the band in one direction, said pressure pulley being arranged in a region in which the enveloping component wraps around one of the two wheels to thereby Press the enveloping component against one of the two wheels, a reversing mechanism connected to reverse the direction of rotation of the enveloping component, so that the band can be moved both in a feeding direction and in a tensioning direction, and a tensioning wheel located opposite the outer surface (20) of the enveloping component and being moveable during a tensioning phase, to press the band (2) onto the enveloping component in order to apply a band tension.

* * * * *